US009200856B2

(12) United States Patent
Moretti

(10) Patent No.: US 9,200,856 B2
(45) Date of Patent: Dec. 1, 2015

(54) BOLT ASSEMBLY WITH IMPROVED ROTATING LOCKING HEAD

(71) Applicant: BENELLI ARMI S.P.A., Urbino (Pesaro Urbino) (IT)

(72) Inventor: Luigi Moretti, Collebeato (IT)

(73) Assignee: BENELLI ARMI S.p.A., Urbino (IT)

( * ) Notice: Subject to any disclaimer, the term of this patent is extended or adjusted under 35 U.S.C. 154(b) by 24 days.

(21) Appl. No.: 14/189,586

(22) Filed: Feb. 25, 2014

(65) Prior Publication Data

US 2014/0251118 A1 Sep. 11, 2014

(30) Foreign Application Priority Data

Mar. 8, 2013 (IT) ..... MI2013A0351

(51) Int. Cl.

| | |
|---|---|
| ***F41A 3/00*** | (2006.01) |
| ***F41A 3/16*** | (2006.01) |
| ***F41A 3/20*** | (2006.01) |
| ***F41A 3/26*** | (2006.01) |

(52) U.S. Cl.

CPC ... *F41A 3/16* (2013.01); *F41A 3/20* (2013.01); *F41A 3/26* (2013.01)

(58) Field of Classification Search

USPC ..... 42/16, 19, 17, 69.01, 69.03; 89/17

See application file for complete search history.

(56) References Cited

U.S. PATENT DOCUMENTS

| | | | | |
|---|---|---|---|---|
| 5,722,194 | A * | 3/1998 | Wurger et al. | 42/69.02 |
| 2003/0066226 | A1 | 4/2003 | Martin | |
| 2009/0077852 | A1 | 3/2009 | Steimke et al. | |

FOREIGN PATENT DOCUMENTS

| | | | |
|---|---|---|---|
| DE | 713126 | C | 11/1941 |
| EP | 0128125 | A2 | 12/1984 |
| EP | 1130350 | A2 | 9/2001 |
| RU | 2066820 | C1 | 9/1996 |

* cited by examiner

*Primary Examiner* — J. Woodrow Eldred

(74) *Attorney, Agent, or Firm* — R. Neil Sudol; Henry D. Coleman

(57) ABSTRACT

A bolt assembly with improved rotating locking head, comprising a rotating locking head associated with a bolt body and movable with respect to the bolt body with a combined rotary and translational motion; the rotating locking head having at least two working positions: a closed position, wherein the rotating head closes the breech of the firearm, and an open position, wherein the rotating head is at a distance from the breech; the bolt assembly has an auxiliary pusher that biases the rotating head from the open position to the closed position.

4 Claims, 7 Drawing Sheets

BOLT ASSEMBLY WITH IMPROVED ROTATING LOCKING HEAD

BACKGROUND OF THE INVENTION

The present invention relates to a bolt assembly with improved rotating locking head.

Rotating bolts are found in gas-operated, recoil-operated, bolt action, lever-action and pump-action weapon designs.

A rotating bolt typically comprises a rotating head provided with lugs or radial lugs that engage seats provided in the barrel extension.

Generally, the rotating head can move with respect to the body of the bolt by means of a system with a pivot and a helical cam that imparts a combined rotary and translational motion to the rotating head.

Systems are known in which the helical cam is formed in the rotating head and others are known in which the helical cam is formed in the body of the bolt and engages a radial pivot that is integral with the bolt body, in the first case, and integral with the rotating head, in the second case.

EP0128125 discloses a bolt assembly of the type described above which has had, and continues to have, widespread application.

EP1130350 discloses a breechblock with a rotating head wherein a forcibly controlled stopping means, associated with the breechblock sleeve, blocks the angular momentum which effects the locking of the breechblock.

DE713126 discloses a breechblock for a machine-gun having an auxiliary spring adapted to accelerate the closure motion of the head.

Conventional rotating head bolts, applied to hunting rifles, in fact have shown some anomalies in operation due to particular situations that can occur during hunting activities.

It has been observed that, when carrying the rifle on one's shoulder with the muzzle directed upward, due to an impact, for example caused by the hunter jumping over a ditch, the rotating head might disengage from the locked position, ready for firing. That happens because the rotating head is not blocked by the recovery spring and is able to retract, with the lugs disengaging from the seats of the barrel extension.

If this occurs, and the hunter does not notice, when it is time to fire, the bolt is not locked and the firearm will not fire. If the animal does not flee immediately, certainly it flees when it hears the forced re-locking of the bolt by the hunter.

In order to lock the bolt manually, the hunter has to act on it, moving it backward and then sharply pushing it forward, to ensure that the rotating head returns to the locked position.

An additional problem of such action is that, in general, it is not easy to lock the bolt with a slow and quiet motion, because the rotating head tends to stop in the position that corresponds to the entry plane of the seats provided in the barrel, without completing the locking, because the lugs or lugs of the rotating head are not aligned with said seats. This occurs because the rotating head lacks the residual energy to complete the rotation and translation needed to allow the insertion of the lugs in the seats of the barrel.

Such problem may occur if the hunter wishes, for example, to change the cartridge to adapt it to the target that becomes available and must do so silently to avoid startling the animal. However, the hunter might be unable to re-load the firearm with a slow and consequently silent motion and might be forced to push the bolt sharply into the locking position, thus startling the animal and causing the target to flee.

OBJECTS OF THE INVENTION

The aim of the invention is to provide a rotating head bolt assembly with improved locking that solves the above mentioned problems.

An object of the invention is to provide a bolt assembly adapted to weapons of various designs such as gas-operated, recoil-operated, bolt action, lever-action and pump-action weapons.

A further object is to provide a system that does not influence in any way the normal operation of the firearm.

A further object is to provide a system that can be applied to existing bolts.

A further object of the invention is to provide a bolt assembly that does not require additional maintenance besides that already provided for traditional bolts.

A further object of the present invention is to provide a bolt assembly which is reliable and safe.

SUMMARY OF THE INVENTION

This aim and these and other objects that will become better apparent hereinafter are achieved by a bolt assembly with improved rotating locking head, comprising a rotating locking head associated with a bolt body and movable with respect to said bolt body with a combined rotary and translational motion; said rotating locking head having at least two working positions: a closed position, wherein said rotating head closes the breech of the firearm, and an open position, wherein said rotating head is at a distance from said breech; said bolt assembly further comprising a bias means that biases said rotating head from said open position to said closed position.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
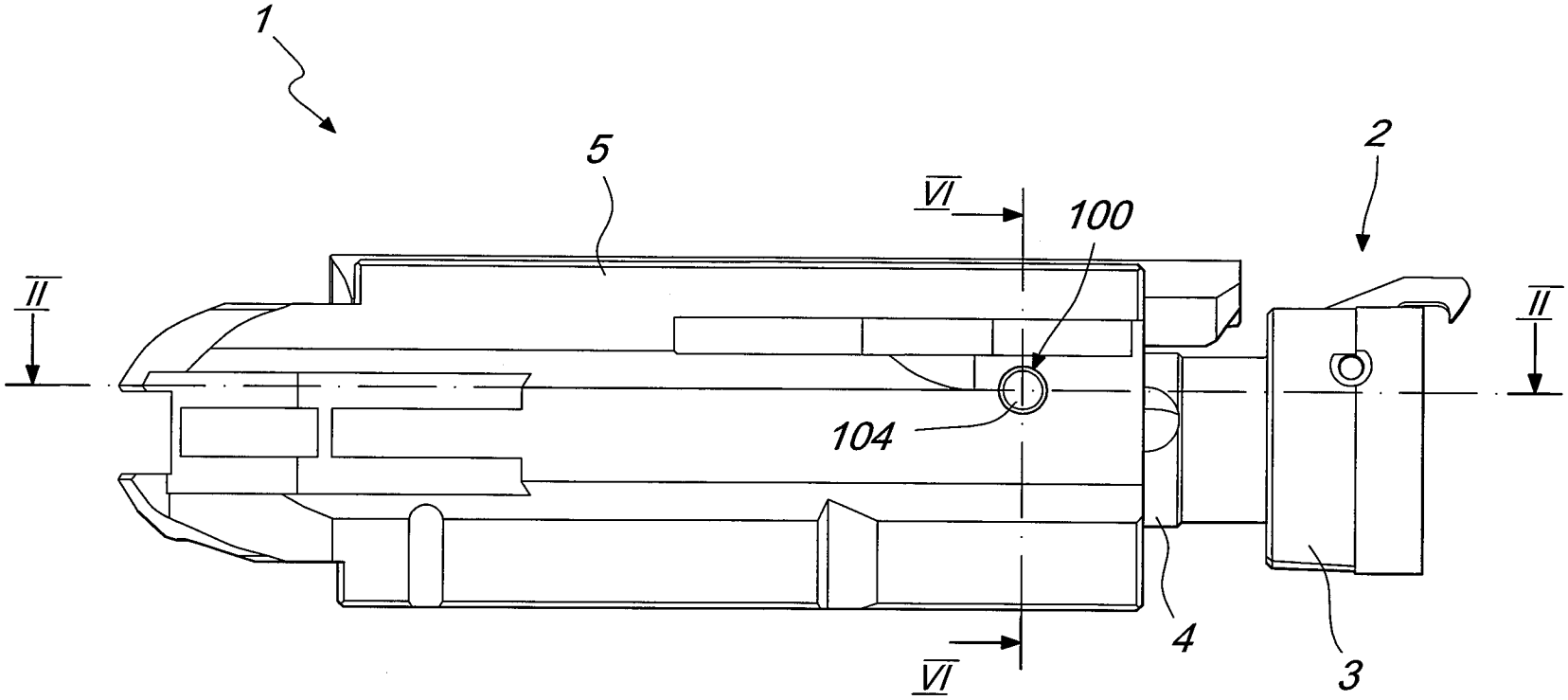
FIG. 1 is a bottom view of the bolt assembly according to the present invention.
Figure 2:
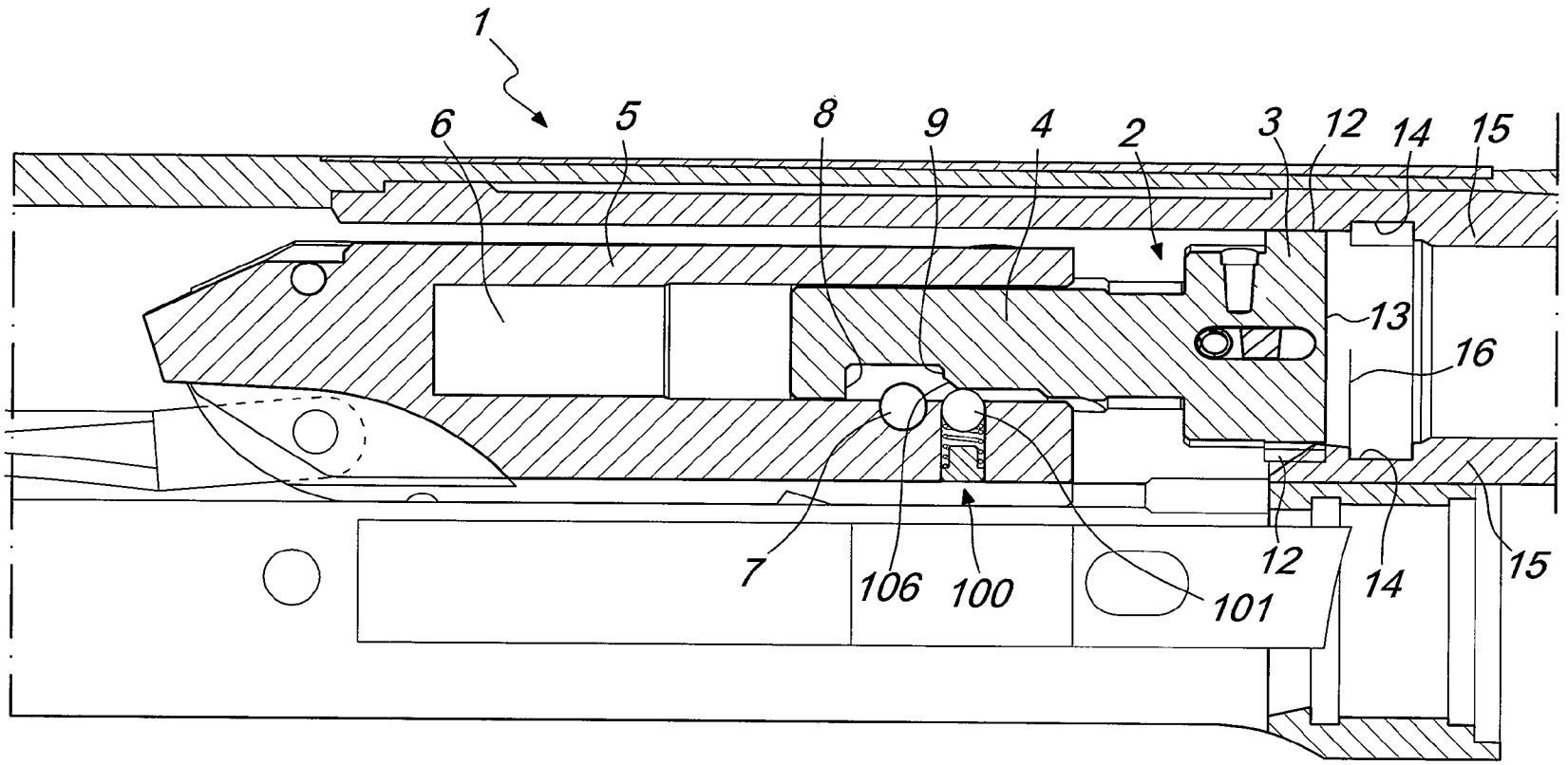
FIG. 2 is a longitudinal sectional side view of the bolt assembly, showing the bias means in the work end position.

With reference to the cited figures, the rotating head bolt assembly with improved locking, according to the invention, generally designated by the reference numeral 1, comprises a rotating locking head 2, which comprises a cylindrical head 3 and a shaft 4.

The shaft 4 of the rotating head slides in a longitudinal hole 6 of the bolt body 5 and is kept in an inactive position by means of a pin 7 that is engaged in a notch formed in the shaft 4; the notch has a rear surface 8 and a front surface 9, where the terms rear and front refer to the position relative to the breech.

The shaft 4 has a radial pivot 10, which engages a helical cam groove 11, formed in the bolt body, imparting a rotary motion to the locking head when it translates in an axial direction.

The cylindrical head 3 is provided with lugs 12, which are arranged radially and form a single front locking plane 13.

The lugs 12 engage corresponding radial seats 14 provided in the rear extension of the barrel 15 so as to lock the breech.

Figure 4:
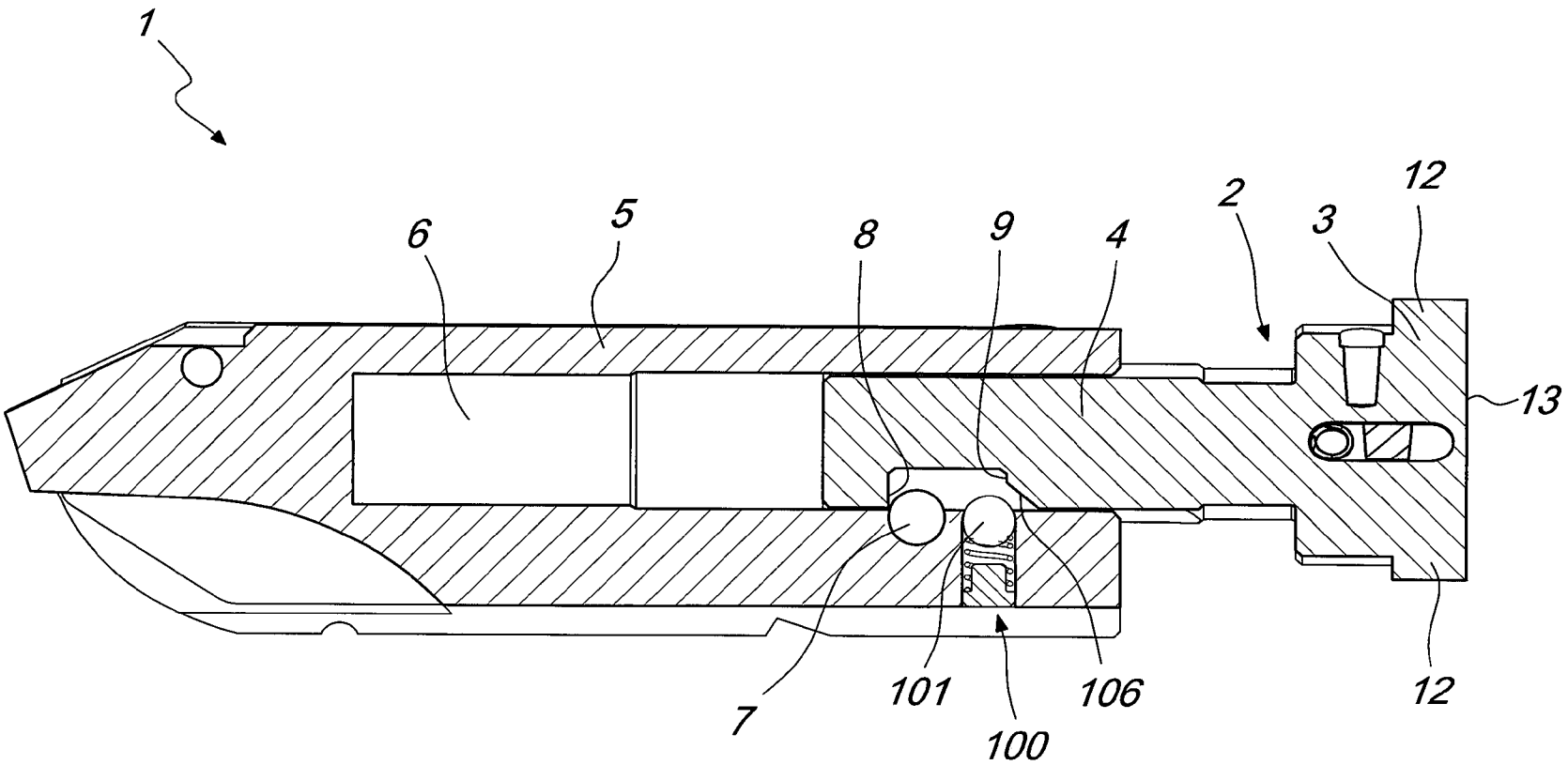
FIG. 4 is a longitudinally sectional side view, taken along the sectional plane II-II of FIG. 1, showing the bolt assembly in the open position.
Figure 5:
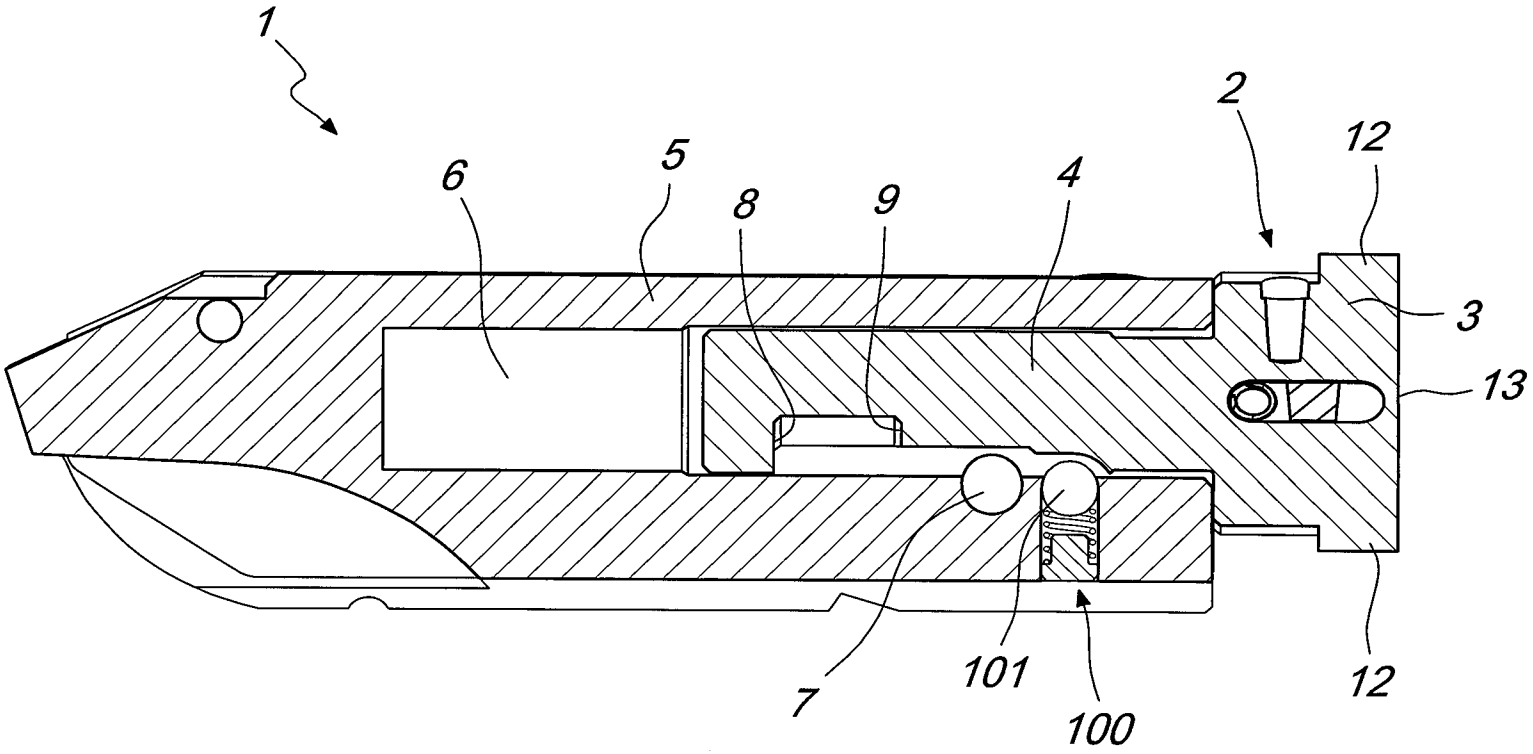
FIG. 5 is a view, similar to the preceding one, showing the bolt assembly in the locked position.

The bolt assembly 1 has two working positions: a locked position, which is visible in FIG. 5, and an open position, which is visible in FIG. 4.

In the open position, the head 3 is spaced from the locking plane and rotated in such a position that the lugs 12 are not axially aligned with the respective seats 14 of the barrel.

Figure 7:
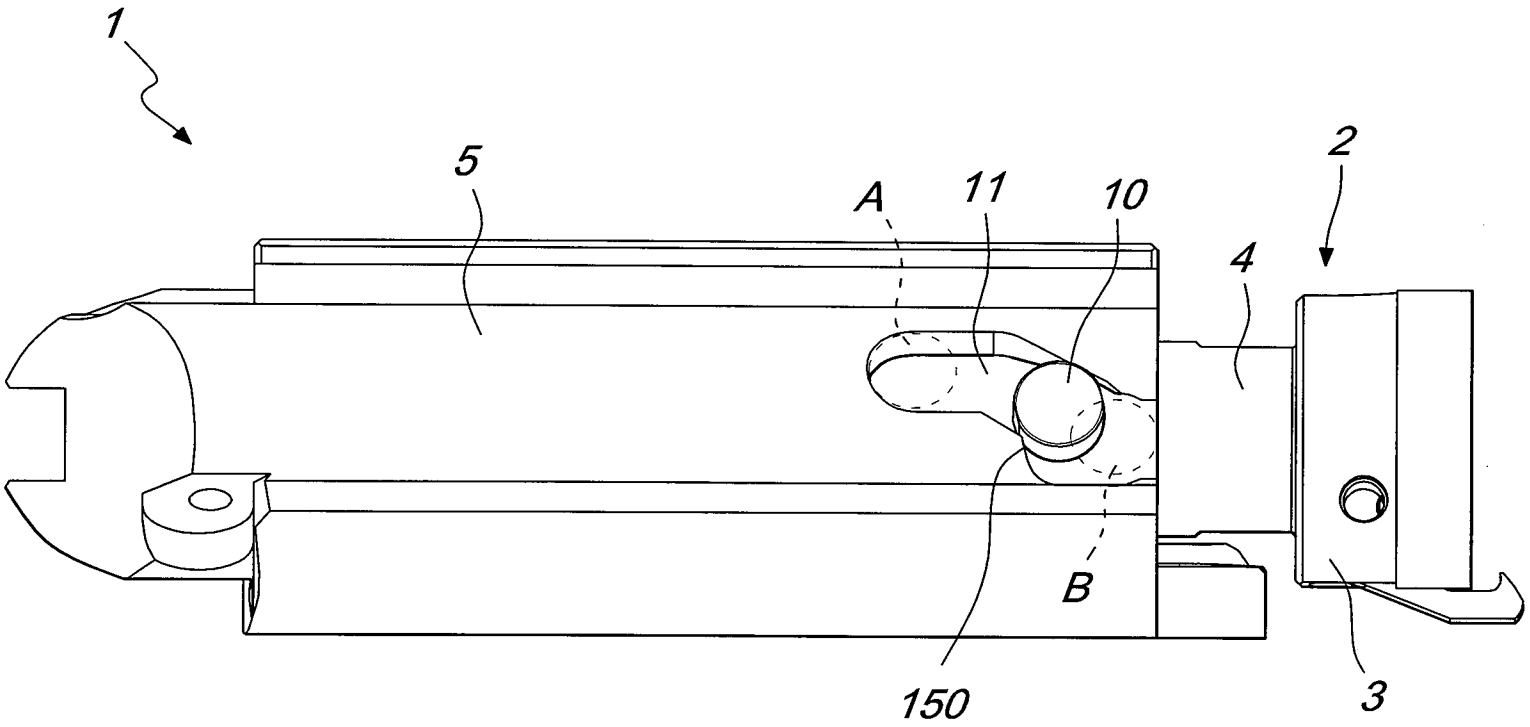
FIG. 7 is a plan view of the bolt assembly.

FIG. 7 shows how the rotary and translational motion of the rotating head 2 with respect to the body of the bolt 5 is guided by the pivot 10, which is forced to follow the shape of the helical cam groove 11.

In the transition from the open position to the locked position, the pivot 10 moves from the position designated by the reference letter B to the position designated by the reference letter A.

During this motion, the pivot 10 encounters an inclined plane 150, which is formed in the groove 11 to prevent the skipping of the bolt head during normal operation of the firearm.

After passing beyond the inclined plane 150, the pivot 10 imparts a further rotation to the cylindrical head 3, allowing the lugs 12 to align with the seats 14 and enter them by virtue of the additional translational motion of said head.

According to the present invention, the bolt assembly is provided with a bias means adapted to facilitate the locking of the rotating head.

Figure 3:
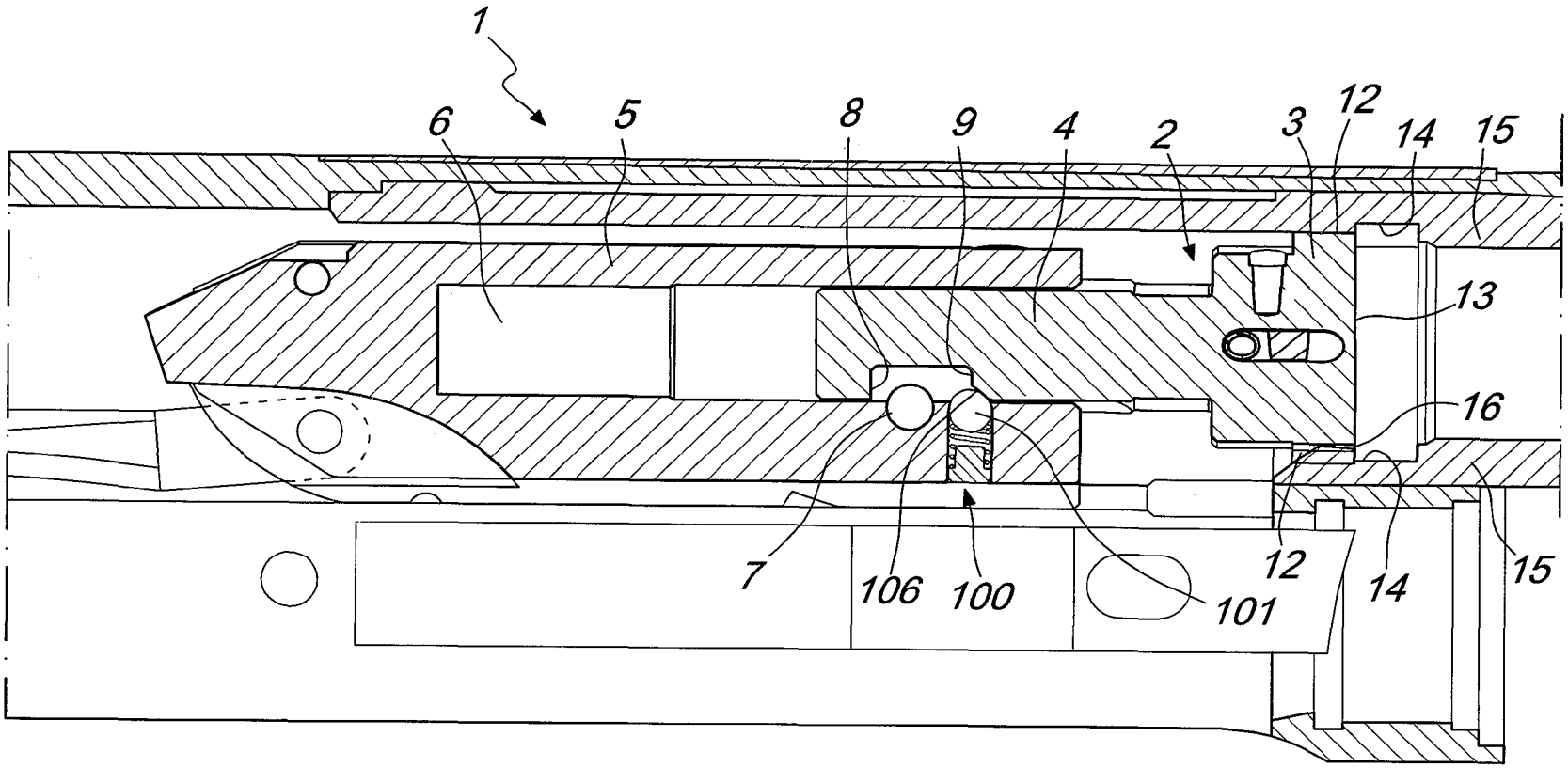
FIG. 3 is a view, similar to the preceding one, showing the bolt assembly with the rotating head at the plane of insertion of the seats, during the intervention of the bias means.

The bias means, generally designated by the reference numeral 100, acts in the step for passing from the position shown in FIG. 3 to the locked position, shown in FIG. 5.

When the cylindrical head 3 is in the position in which the front locking plane 13 is adjacent to the insertion plane of the seats 14, designated by the reference numeral 16, the lugs 12 are not aligned with the seats 14 and therefore an additional rotary motion of the head 3 is necessary to align the lugs with the seats and allow their insertion.

In this step the bias means begins to operate and presses on the head with a pressure that is sufficient to impart a rotation and a translation to the head.

In the normal operation of the firearm, the bias means is not necessary to perform the complete locking of the bolt, since the inertial force of the bolt assembly is sufficient.

The bias means 100 starts to operate when the movement of the bolt, performed manually, is slow, when for example the user wishes to load the firearm without making noise.

The bias means 100 also prevents the rotating head 3 from disengaging from the locked position, due to impacts and other sudden motions, because it is free to move with respect to the bolt body 5.

In the constructive example described herein, the bias means 100 comprises a ball 101 that is inserted in a radial hole 102 provided in the bolt body 5.

The ball 101 is biased by a bias spring 103, which is held or set by a rivet 104 that is forced in the radial hole 102, so as to abut shaft 4 at the opening 105 formed in the internal surface of the longitudinal hole 6, at the radial hole 102.

When the rotating head is inserted in the bolt body and the pivot 10 is in the position A, with reference to FIG. 7, the ball 101 abuts against the surface of the shaft 4.

When the rotating head 2 moves in the direction of the breech, in order to lock, the ball 101 is at an inclined plane 106, which is formed on the front surface 9 of the notch of the shaft 4 and, being pushed by the bias spring 103, acts on the inclined plane 106, rotating the rotating head 2 and facilitating its rotary and translational motion toward the breech plane in order to complete the locking.

When the bolt is locked, in the position shown in FIG. 5, the bias means 100 prevents the rotating head 3 from disengaging from the locked position, because the ball 101 acts on the inclined plane 106, preventing the retraction of the head 3.

The bias means therefore prevents the rotating head from disengaging from the locked position when the firearm is, for example, shoulder carried with the muzzle directed upward and, due to an impact, the bolt is pushed downward by gravity.

Figure 6:
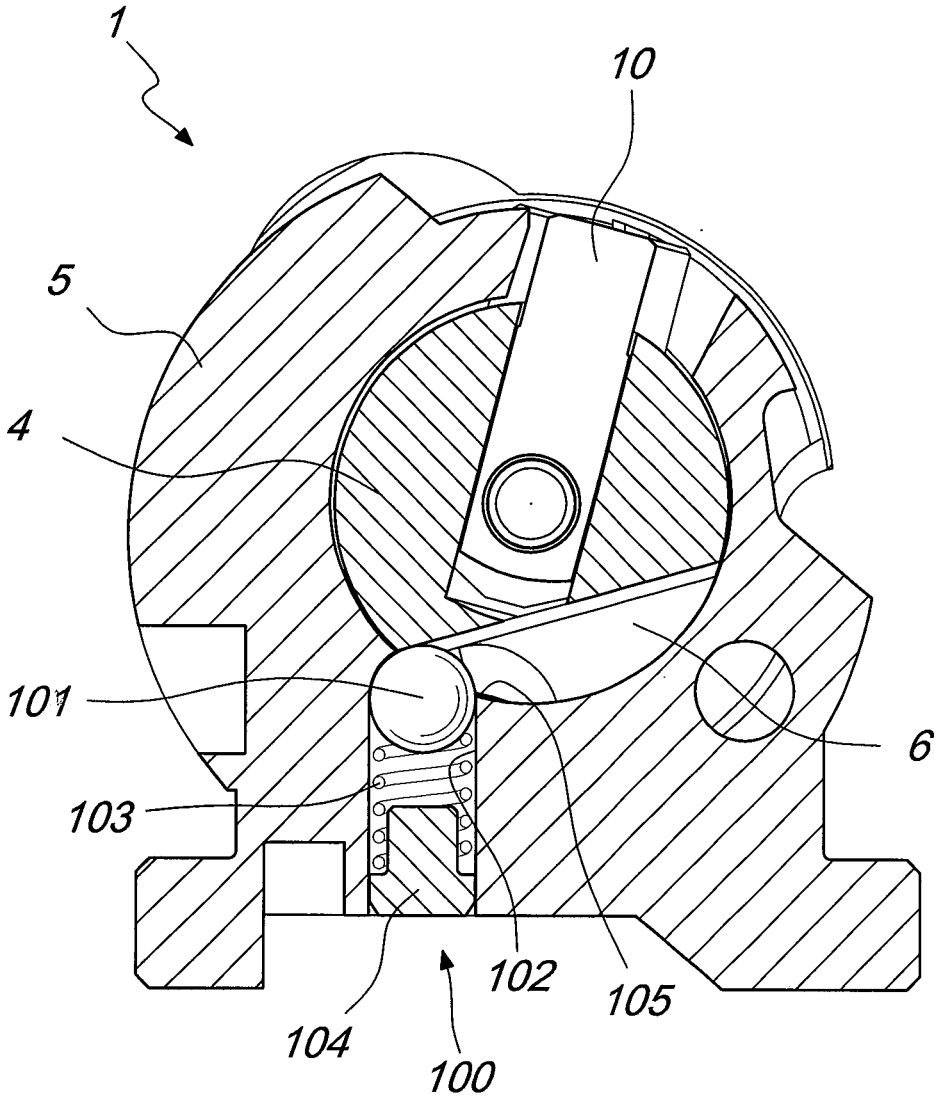
FIG. 6 is a transverse sectional view, taken along the plane VI-VI of FIG. 1, of the bolt assembly.

Another useful intervention of the bias means is in the case in which the firearm is loaded manually with a slow movement on the part of the user. If the user does not sharply push the bolt, the rotating head might stop in the position shown in FIG. 6, in which the front locking plane 13 of the cylindrical head 3 is adjacent to the insertion plane 16 of the seats 14 and the lugs 12 are not aligned with the seats 14. At this point the bias means intervenes and supplies the thrust required to complete the rotary and translational motion in order to perform complete locking.

In practice it has been found that the invention achieves the intended aim and objects, a bolt assembly with rotating head having been provided which facilitates locking by virtue of a bias means that intervenes in particular conditions of use.

Unlike the auxiliary spring of, for example, EP1130350 and DE713126, the bias means of the present invention does not influence the closing force of the bolt.

Also, the bias means of the present invention does not intervene in the normal operation of the firearm and has no effect on the general structure thereof.

Another advantage of the system according to the present invention resides in that it can be applied to existing firearms with an oscillating bolt with rotating head.

The invention claimed is:

1. A bolt assembly with improved rotating locking head, comprising a rotating locking head associated with a bolt body of a firearm and movable with respect to said bolt body with a combined rotary and translational motion, the firearm having a breech with a breech plane; said rotating locking head having at least two working positions: a closed position, wherein said rotating locking head closes the breech of the firearm, and an open position, wherein said rotating locking head is at a distance from said breech;

said rotating locking head comprising a cylindrical head and a shaft; said shaft being slidingly movable in a longitudinal hole formed in said bolt body and being retained by means of a pin that engages a notch formed in said shaft; said notch having at least a front surface;

said bolt assembly further comprising a bias means that biases said rotating locking head from said open position to said closed position;

wherein said bias means comprises a ball inserted in a radial hole formed in said bolt body; said ball being biased by a bias spring that is held or set by a rivet forced in said radial hole, said ball abutting said shaft at an opening formed on the inner surface of said longitudinal hole at said radial hole; said ball abutting a surface of said shaft when said rotating locking head is in said open position; when said rotating locking head moves towards said locked position, said ball being located at an inclined plane formed on said front surface of said notch of the shaft and, biased by said bias spring, said ball acts on said inclined plane, causing said rotating locking head to rotate, facilitating a translation of said rotating locking head toward the breech plane in order to complete the locking.

2. The bolt assembly according to claim 1, wherein said notch has a rear surface and said front surface; said shaft having a radial pivot, said radial pivot engaging a helical cam groove formed in the bolt body and imparting a rotary motion to said rotating locking head when said rotating locking head moves in an axial direction.

3. The bolt assembly according to claim 2, wherein said cylindrical head is provided with radially arranged lugs forming a front locking plane; said lugs being adapted to engage corresponding radial seats formed in a rear extension of the gun barrel and to lock the breech plane; in said open position said cylindrical head being spaced from said breech plane and being rotated in a position wherein said lugs are not aligned with said respective seats of the gun barrel.

4. The bolt assembly according to claim 1, wherein, in said locked position, said bias means prevents said rotating locking head from disengaging from said closed position, said ball acting on said inclined plane preventing a backward motion of said rotating locking head.

* * * * *